US006440014B1

(12) United States Patent
Checko et al.

(10) Patent No.: US 6,440,014 B1
(45) Date of Patent: Aug. 27, 2002

(54) APPARATUS FOR RELEASABLY CONNECTING A BASKETBALL NET TO A BASKETBALL RIM

(76) Inventors: Billy-Joe Checko, 608-1177 Hornby Street, Vancouver (CA), V6Z 2E9; Clifford B. Hewson, 1802-1552 Esquimalt Avenue, West Vancouver (CA), V7V 1R3

( * ) Notice: Subject to any disclaimer, the term of this patent is extended or adjusted under 35 U.S.C. 154(b) by 0 days.

(21) Appl. No.: 09/864,382

(22) Filed: May 25, 2001

(51) Int. Cl.[7] ..... A63B 63/08
(52) U.S. Cl. ..... 473/489; 473/485
(58) Field of Search ..... 473/485, 489, 473/449, 484, 486, 487, 488, 447, 472, 479, 481

(56) References Cited

U.S. PATENT DOCUMENTS

| | | | |
|---|---|---|---|
| 1,544,453 A | 6/1925 | Harbison | |
| 2,579,312 A | 12/1951 | Garvey | 273/1.5 |
| 3,348,840 A | 10/1967 | Dix | 273/1.5 |
| 4,805,903 A | 2/1989 | McArdle | 273/1.5 R |
| 4,834,368 A | 5/1989 | Qualley | 273/1.5 R |
| 4,905,995 A | 3/1990 | Apo | 273/1.5 R |
| 5,098,091 A | 3/1992 | McGivern | 273/1.5 R |

*Primary Examiner*—Paul T. Sewell
*Assistant Examiner*—M. Chambers
(74) *Attorney, Agent, or Firm*—Lance A. Turlock

(57) ABSTRACT

Apparatus for connecting a basketball net to a basketball rim includes a collar adapted to hold the net in an open position permitting passage of a basketball, and a plurality of suspension arms having hook-shaped upper ends sized to releasably clip on the rim. As well the apparatus may include a suspension arm that has a horizontally extending plate-shaped upper end that is sized to extend outward over the rim and over a reinforcing plate that is typical of many basketball rim structures. The collar and the suspension arms have a thin sheet construction formed from elastic material having plastic memory. Preferably, the suspension arms are sufficiently resilient to flex from their normal shape to a deformed shape permitting the arm to be forcibly pulled downwardly from the rim, and to return to their normal shape upon release of the deforming force. To faciltate manufacture by injection molding, the collar may be constructed in connectable segments. The installation on and the removal of a collar from a basketabll rim in accordance with the present invention may be accomplished from the level of a basketball floor with the assistance of a positioning device which includes an elongated positioning pole and a positioning head located at the upper end of the pole.

23 Claims, 9 Drawing Sheets

APPARATUS FOR RELEASABLY CONNECTING A BASKETBALL NET TO A BASKETBALL RIM

FIELD OF THE INVENTION

This invention relates to sports and games and, in particular, to apparatus for releasably connecting a basketball net to a basketball rim.

BACKGROUND TO THE INVENTION

The prior art reveals a variety of devices designed to releasably connect basketball nets to basketball rims. The need for such devices arises primarily because nets that might otherwise be provided are subject to theft and vandalism in many basketball courts, particularly those courts that are unsupervised and open to the public. Further, the need arises because when a net is connected directly to a basketball rim it is usually necessary to use a ladder or some other means of elevation to do the job.

An early example of devices for releasably connecting a basketball net to a basketball rim is disclosed in U.S. Pat. No. 1,544,453 granted to Harbison on Jun. 30, 1925. More recent examples are disclosed in U.S. Pat. No. 4,805,903 granted to McArdle on Feb. 21, 1989, U.S. Pat. No. 4,834,368 granted to Qualley on May 30, 1989, U.S. Pat. No. 4,905,995 granted to Apo on Mar. 6, 1990, and U.S. Pat. No. 5,098,091 granted to McGivern on Mar. 24, 1992.

Harbison discloses a wire or metal ring which is suspended by a number of small hooked springs from a basketball rim while holding a net. However, it would appear necessary to use a ladder in order to position and connect the ring with the rim. Further, while the springs are said to relieve the shock of a basketball on the net, it is doubtful that they themselves could stand the shock of a player grabbing the net or the ring without permanent damage or deformation.

McArdle and Apo both disclose rings or collars for supporting a basketball net, such rings or collars being characterized by a cylindrical main body that fits downwardly within the inner circumference of a basketball rim, and by an integrally formed upper flange or lip that extends outwardly from the main body to overlie the entire top circumference of the rim. A basketball net is connected to the main body. However, it is to be noted that such designs would be subject to variety of relatively severe forces if players were to grab the net during play, and they are not well adapted to absorb such forces in a way that would serve to minimize stresses on the collar. As well, such collars appear undesirably prone to dislodgement from the basketball rim during play. To address the latter problem, McArdle requires the added inclusion of a magnetic strip which serves to adhere the collar to the rim. In the case of Apo, he teaches that the collar may be dislodged merely by throwing a basketball up through the net. This may be a desirable attribute at the end of a game, but not during play when the collar might bounce from the rim at inopportune times if impacted n by a basketball from the right direction.

Both McArdle and Apo also disclose the use of a pole to elevate a collar up to a basketball rim. To facilitate both installation and removal, McArdle includes a small vertical hole in the outwardly extending lip of his collar, the hole being designed to be engaged by a spike at the upper end of his pole. However, the hole is blocked when the collar is on the rim. Therefore, the lip includes a notch extending towards the hole to direct insertion of the spike during removal of the collar. The upper end of Apo's pole includes a pair of projecting pins forming a V-shape designed to engage his collar. However, it does not appear that the pins would be able to hold the collar with any high degree of stability while the collar is being elevated. Further, it does not appear that they are at all well adapted to facilitate removal of the collar from the rim.

The designs of Qualley and McGivern both would require the use of a ladder or the like during installation on or removal from a basketball rim.

A primary object of the present invention is to provide new and apparatus for releasably connecting a basketball net to a basketball rim, such apparatus being well adapted to absorb stresses that may occur during basketball play, and being well adapted to facilitate both connection and disconnection of the net to and from the rim from the level of a basketball floor.

A further of object of the present invention is to provide new and improved apparatus of the foregoing type which is designed for ease of manufacture.

SUMMARY OF THE INVENTION

In a broad aspect of the present invention, there is provided apparatus for releasably connecting a basketball net to a basketball rim, such apparatus comprising a collar adapted to hold the net in an open position permitting passage of the basketball and a plurality of suspension arms located at predetermined positions around the circumference of the collar. Generally, all suspension arms or all but one suspension arm extend upwardly from a lower end secured to the collar to a normally hook-shaped upper end. In a preferred embodiment, one of the suspension arms extends upwardly from a lower end secured to the collar to a horizontally extending plate-shaped upper end. The plate-shaped upper end is sized to extend outward over the rim and over the horizontally and rearwardly extending reinforcing plate which is typical of many basketball rim structures.

Each of such hook-shaped upper ends is sized to releasably clip on the rim and, in cooperation with the remaining ones of the hook-shaped upper ends (and if present the plate-shaped upper end), to suspend the collar with the net below the rim in a position for basketball play.

The collar and the suspension arms have a thin sheet construction formed from elastic material having plastic memory. Preferably, each suspension arm is sufficiently resilient to flex from its normal shape to a deformed shape permitting the arm to be forcibly pulled downwardly from the basketball rim, and to return to its normal shape upon the release of such force.

In one embodiment, the circumference of the collar is defined by circumferential segments, including a first circumferential segment to which the lower ends of hook-shaped suspension arms are secured as aforesaid, and a second circumferential segment connected to and axially offset from the first circumferential segment. As is described hereinafter in more detail, the provision of the offset permits a collar in accordance with the present invention to be used with rims which are connected to a backboard by bracing that might otherwise interfere with the collar.

In a preferred embodiment that includes the plate-shaped upper end noted above, the collar comprises three discrete circumferential segments that are connect with each other to form the collar. The suspension arm that has the plate-shaped upper end is associated with a first one of the segments. The remaining suspension arms (all having hook-shaped upper ends) are associated with the other two segments.

The installation and removal of a collar in accordance with the present invention may be accomplished with the assistance of a positioning device which comprises an elongated positioning pole and a positioning head located at the upper end of the pole. The device enables a user to easily instal or remove the collar while standing on the level of a basketball floor.

The foregoing and other features and advantages of the invention will now be described with reference to the drawings.

DETAILED DESCRIPTION OF PREFERRED EMBODIMENTS

Embodiment Shown in FIGS. 1 to 12

Figure 1:
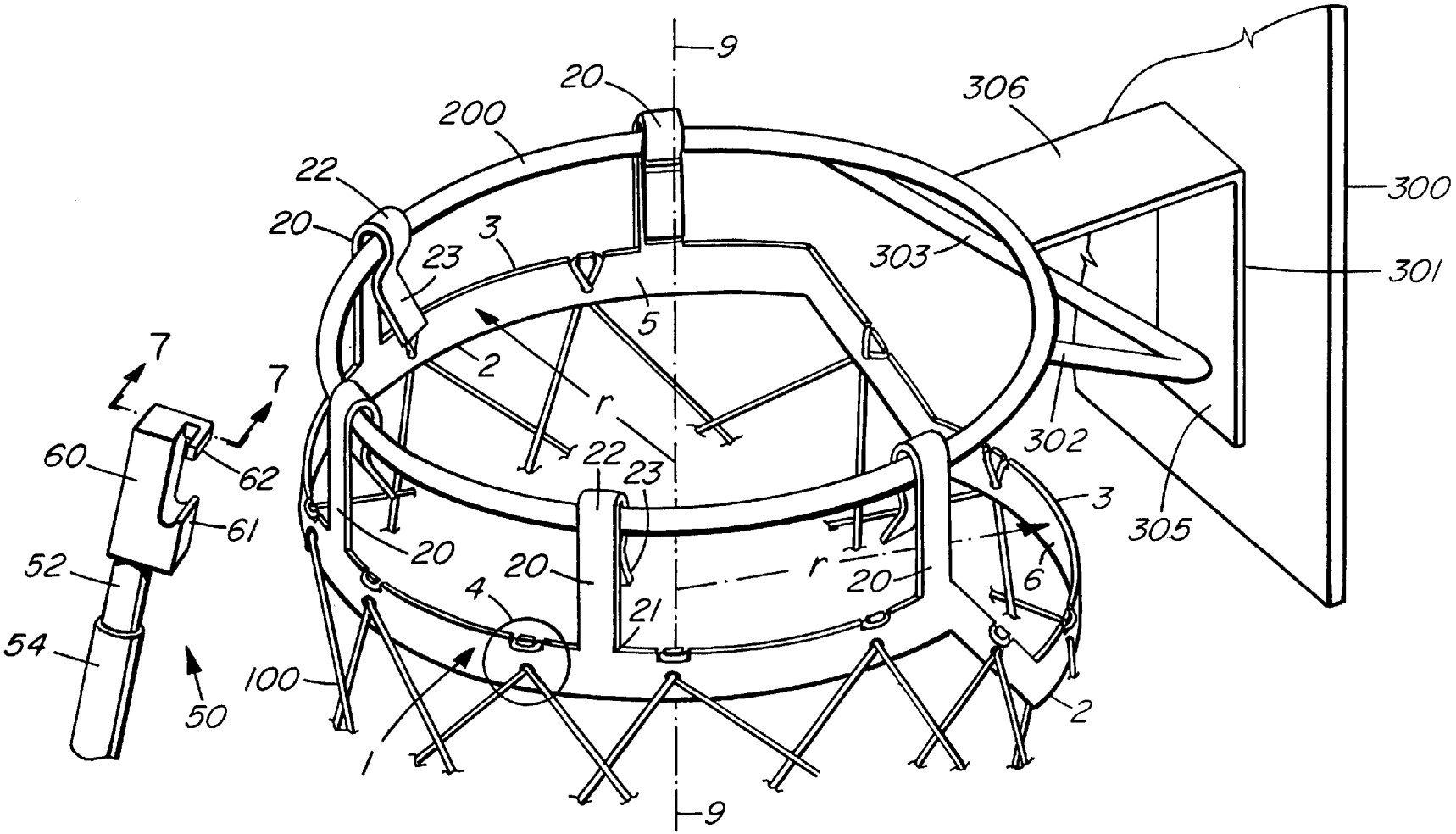
FIG. 1 is an isometric view of one embodiment of apparatus in accordance with the present invention, including a net holding collar with suspension arms extending upwardly from the collar to a basketball rim, and including an associated collar positioning device.

Referring now to FIG. 1, there is shown a collar generally designated 1 with a plurality (five as shown) of suspension arms 20 located at predetermined intervals around the circumference of the collar. FIG. 1 also shows, partially cut away, a positioning device generally designated 50. Collar 1 is suspended from a conventional basketball rim 200. A conventional net 100 (shown only in part) is connected to the collar. It is to be understood that the rim per se and the net per se are not considered to be part of the invention.

Collar 1 has a thin sheet construction formed into a continuous loop from elastic material having plastic memory. It is comprised of two circumferential segments 5, 6 each having a radius "r" measured relative to a central axis 9 of the collar. A lower perimeter 2 is defined around the bottom circumference of the collar. Similarly, an upper perimeter 3 is defined around the top circumference of the collar.

Suspension arms 20 are integral with collar 1 and likewise have a thin sheet construction formed from elastic material having plastic memory.

Figure 2:
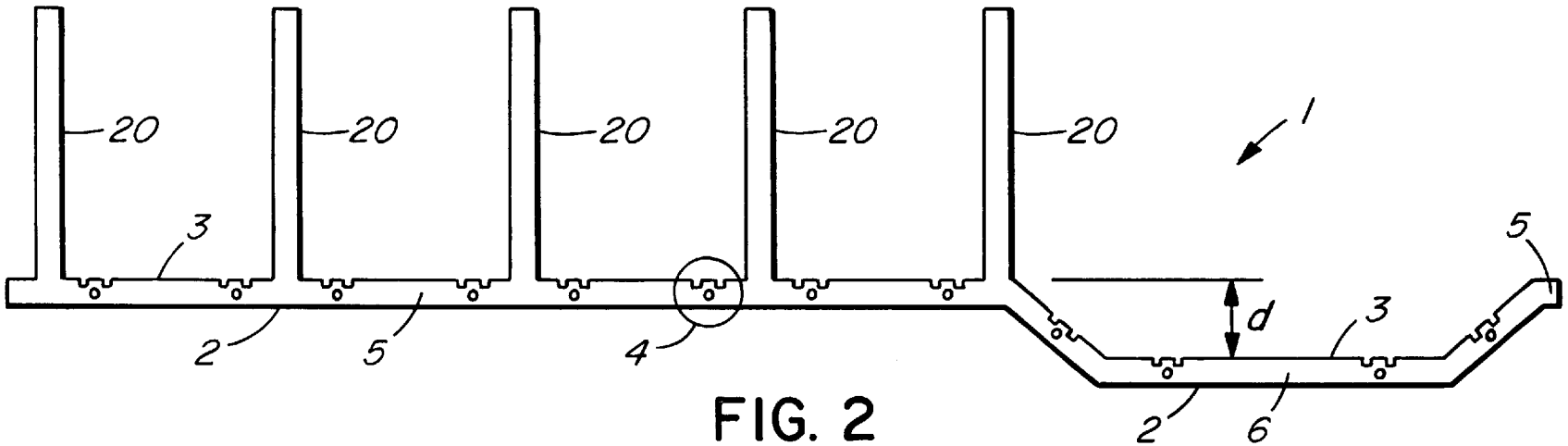
FIG. 2 is an elevation view showing the collar and suspension arms in FIG. 1 when mapped to a flat plane.

When mapped to a flat plane, collar 1 and suspension arms 20 have the layout shown in FIG. 2. As can be seen in FIG. 2, segments 5 and 6 are connected to each other but are axially offset by a distance "d".

Figure 3:
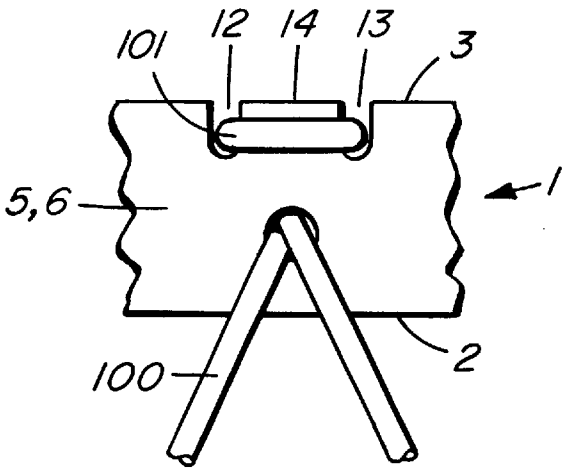
FIG. 3 illustrates in more detail how a basketball net may be connected to the collar shown in FIG. 1.

Collar 1 is adapted to hold a basketball net by means of a plurality of (twelve as shown) hole-and-notch groupings. One of such groupings is contained within the region marked 4 in FIGS. 1 and 2. As best seen in FIG. 3, each such grouping includes a hole 11 through which an upper part of the web of net 100 is strung, and a pair of notches 12, 13 defining a tab 14 over which the web is then looped at 101 to secure the net to the collar.

Each suspension arm 20 extends upwardly from a lower end 21 that merges with collar 1 (more particularly, with upper perimeter 3 of collar 1 on segment 5) to a normally hook-shaped upper end or clip 22 which includes a downwardly and outwardly extending flange 23. Clip 22 is sized to releasably hook by means of a snap fit on rim 200 in the manner indicated in FIG. 11.

Figure 12:
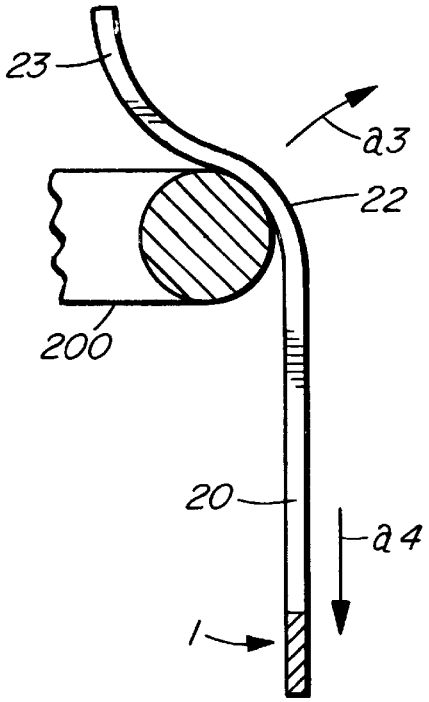
FIG. 12 is a side elevation view illustrating the suspension arm in FIG. 11 when being forcibly pulled downwardly from the basketball rim.

Each clip 22 is not only sufficiently resilient to facilitate the desired snap fit on rim 200 but also to be forcibly flexed to a substantially deformed shape such as that shown in FIG. 12, and to then return to its normal shape. Such resilience and flexibility can be achieved with various elastic materials having plastic memory, for example an acetal homopolymer, polycarbonate or nylon plastic.

As indicated above, collar 1 and suspension arms 20 are formed as one integral piece. This is done by first taking a thin flat sheet and cutting it to the pattern shown in FIG. 2. Then, with gentle heating, the upper portion of each suspension arm 20 is molded to the desired hook shape. Then, the opposed ends of collar 1 as shown in FIG. 2 are brought together and joined by a heat weld to form a continuous loop.

Figure 13:
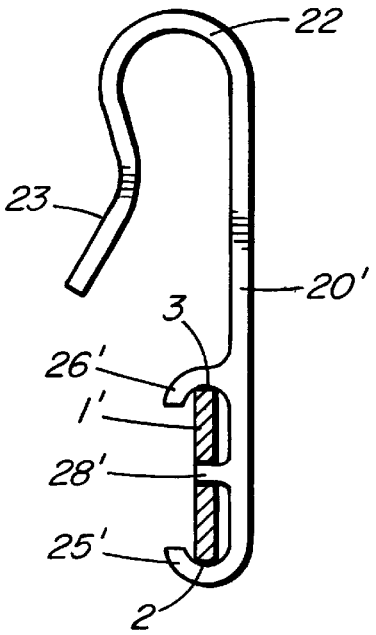
FIGS. 13 and 14 illustrate an alternative suspension arm and net holding collar with which it is associated.
Figure 14:
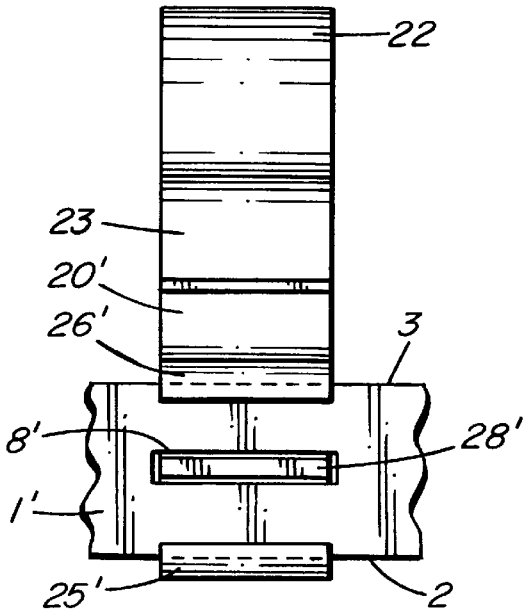

Of course, it is not imperative for suspension arms 20 to be integrally formed with collar 1. For example, an alternative approach is to employ non-integrally formed suspension arms such as suspension arm 20' shown in FIGS. 13 and 14. Suspension arm 20' has a thin sheet construction like that of suspension arm 20, but additionally includes lower and upper clips 25', 26' sized and positioned to snap fit over the lower and upper perimeters 2, 3 of a modified collar 1'. As well, suspension arm 20' includes a projecting rectangular tab 28' sized to be slidingly received and engaged by a corresponding rectangular slot 8' in collar 1'. When so engaged, the position of suspension arm 20' on collar 1' is secured.

An advantage of suspension arm 20' is that it can be produced by injection molding. A disadvantage is that each suspension arm 20' necessarily represents one more part in the overall construction. However, this disadvantage is mitigated to a degree by the observation that if a particular suspension arm 20' is irreparably damaged, then it may be replaced.

Various other means may be devised for securing the lower ends of suspension arms to a collar like collar 1. Such other means may include plastic welding, riveting, etc.

Referring again to the embodiment shown in FIG. 1, clip 22 of each suspension arm 20 has been snap fitted to rim 200. As well, basketball net 100 has been secured to each of the twelve hole-and-notch groupings in collar 1, in the manner indicated in FIG. 3. Net 100 is thus held by collar 1 in an open position that permits passage of a basketball (not shown) in the same manner that rim 200 permits passage of a basketball.

As shown in FIG. 1, rim 200 is mounted to a backboard 300 by an assembly which includes a reinforcing angle bracket 301 and a pair of angular support braces 306, 307. Bracket 301 comprises a vertically extending rear plate 302 secured to backboard 300 and a horizontally extending reinforcing plate 303 which secures rim 200. Such reinforcing arrangements are not uncommon and in some cases may be found to interfere with the positioning of a collar not having an offset portion such as axially offset portion 6 of collar 1. In cases where angular support braces may cause interference, a suitable offset serves to permit the collar to be fitted to a rim while extending around and below the braces. As shown in FIG. 1, the offset portion 6 of collar 1 extends well below braces 306,307. (As in the case of net 100 and rim 200, it is to understood that backboard 300, bracket 301 and braces 306, 307 are not considered to be part of the invention).

The use of five suspension arms 20 has been found to provide good support for collar 1 when the collar is suspended below rim 200 while holding net 100. As well, the use of five suspension arms can serve to facilitate alignment when the collar is being positioned on the rim. In this regard, a first one of suspension arms 20 is preferably positioned at a central point of circumferential segment 5 diametrically across from the central region of circumferential segment 6. The remaining four arms are positioned at approximately 60 degree intervals along segment 5—two on each side of the central arm.

Figure 4:
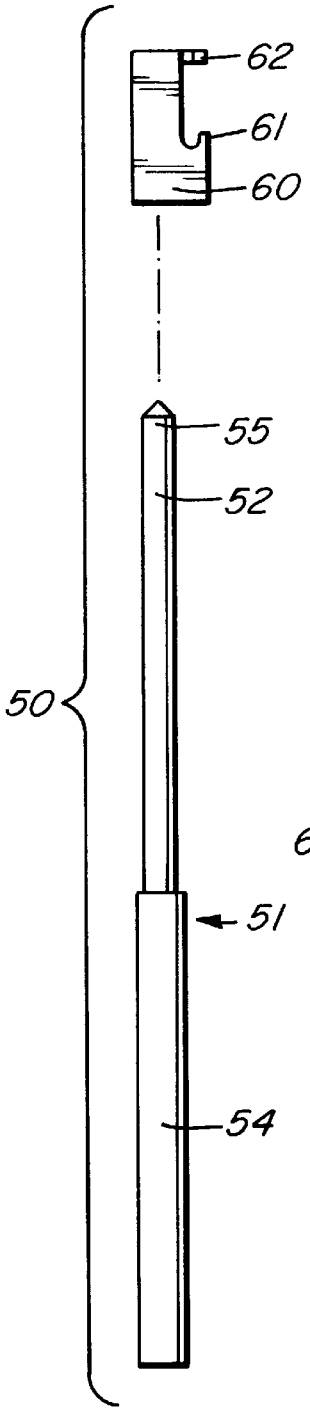
FIG. 4 is a partially exploded elevation view illustrating more completely the positioning device shown in FIG. 1, including a positioning pole and a positioning head locatable on the upper end of the pole.
Figure 5:
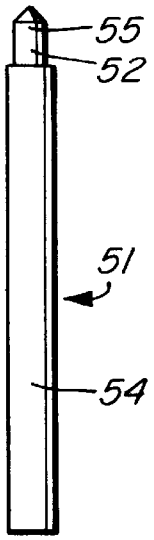
FIG. 5 shows the positioning pole in FIG. 4 in a telescoped condition.

Positioning device 50, an overall view of which is shown in FIG. 4, comprises an elongated positioning pole generally designated 51 and a positioning head 60. Pole 51 includes an upper segment 52 which can be telescopically received as shown in FIG. 5 by a lower segment 54. Upper segment 52 may be held to a desired degree of extension by any suitable means such as collar (not shown) that may be tightened or loosened. Structural details are not be discussed here because poles with telescoping segments are well known, and are commercially available off the shelf.

Figure 6:
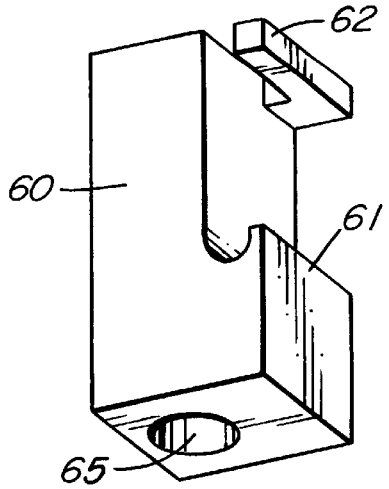
FIG. 6 is an isometric view from the bottom of the positioning head forming part of the collar positioning device shown in FIG. 1.
Figure 7:
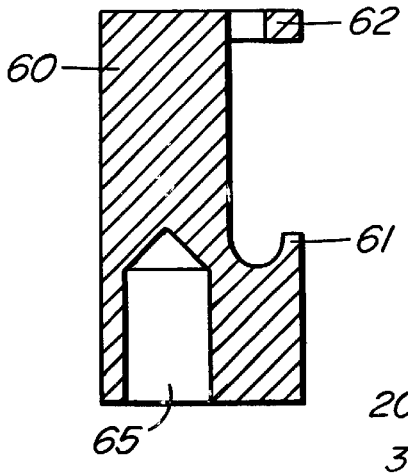
FIG. 7 is a section elevation view of the positioning head taken along section line 7—7 in FIG. 1.

Head 60 includes an upwardly opening lower hook 61 for hooking collar 1 at a selected position from below lower perimeter 2 of the collar (e.g. see FIGS. 8, 9), and a sideways opening upper hook 62 aligned above lower hook 61 for concurrently hooking a selected one of suspension arms 20 from an upwardly extending side 27 of the selected arm (e.g. again see FIGS. 8, 9). As best seen in FIGS. 6 and 7, a hole 65 extends upwardly into the base of head 60. Hole 65 enables head 60 to be slidably located on upper end 55 of the pole 51.

The use of the embodiment shown in FIGS. 1 to 12 will now be described with primary reference to FIGS. 8–12. The initial objective is to suspend collar 1 from rim 200 without the use of a ladder or other such appliance .

In FIGS. 8–12, and although not shown, it should be presumed that a net 100 as partially depicted in FIG. 1 has already been attached to collar 1. It should also be presumed that pole 51 has been extended as shown in FIG. 4 to a degree that will enable the user to easily reach rim 200 from the level of a basketball floor .

Figure 8:
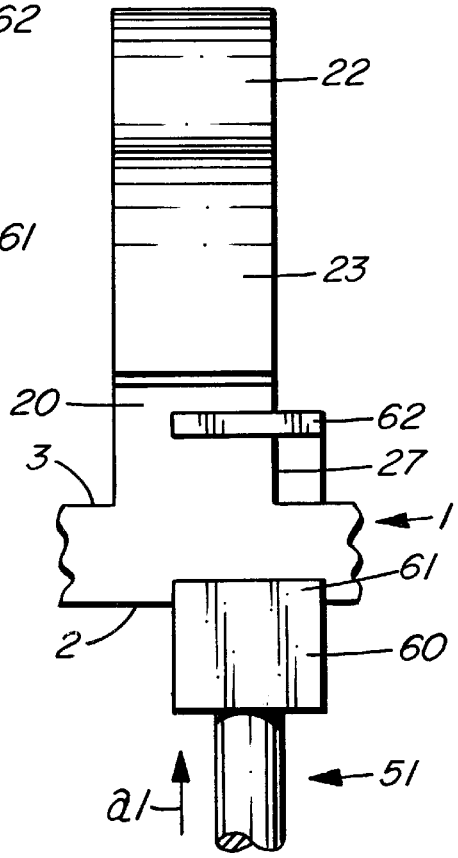
FIG. 8 is an elevation view showing the positioning head hooked with the collar and with one of the suspension arm as the collar is being lifted upwardly with the positioning pole.
Figure 9:
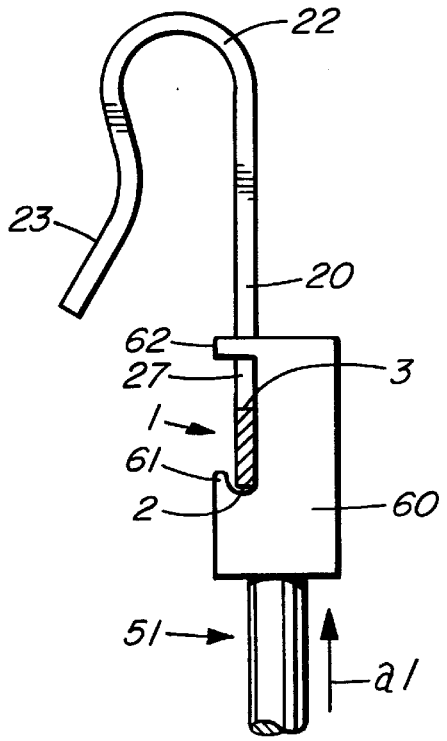
FIG. 9 is a side elevation view showing the collar being lifted upwardly as in FIG. 8.

Collar 1 and a selected suspension arm 20 are first hooked within head 60 in the manner shown in FIGS. 8, 9. Preferably, the selected suspension arm is the arm centrally iu located on circumferential segment 5 of collar 1. Then, while standing on the level of a basketball floor below and immediately in front of a rim 200 (not shown in FIGS. 8, 9), the user elevates the collar towards the rim utilizing positioning device 50 (viz. lifting in the direction of arrow a1 in FIGS. 8, 9). In doing so, the user should be aiming to position the centrally located suspension arm over the forwardmost part of the rim as this will serve to align the axially offset part of collar 1 (viz. segment 6) around and below and angular support braces associated with the rim as discussed above. During this phase, the weight of collar 1 is essentially carried within lower hook 61 of head 60. Concurrently, upper hook 62 limits movement of suspension arm 20 in a manner which prevents the collar from tipping while it is being elevated.

Figure 10:
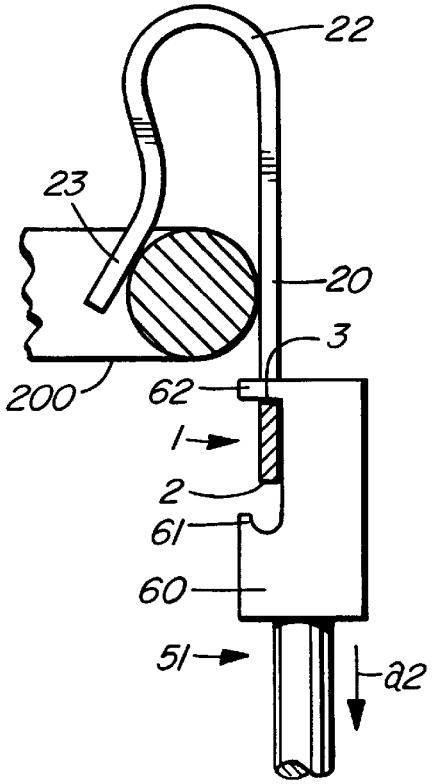
FIG. 10 is a side elevation view illustrating the use of the positioning head to pull the suspension arm shown in FIG. 9 downwardly to clip on a basketball rim

FIG. 10 illustrates the position of collar 1 after it has been lifted sufficiently high to allow clip 22 to settle on top of rim 200. In this position, the weight of the collar (and net, not shown) is being carried primarily by flange 23 on rim 200. Head 60 has been lowered to a point where the underside of upper hook 62 is just above or flush with upper perimeter 3 of collar 1. If the weight acting on flange 23 is insufficient to force clip 22 to snap fit on rim 200 to the position shown in FIG. 11, then the user needs merely to pull down on upper perimeter 3 with the underside of upper hook 62 (viz. in the direction of arrow a2 in FIG. 10).

Note: The last step implies that while head 60 is slidably located on upper end 55 of pole 51 the resulting fit should be a snug fit. Otherwise, head 60 would simply slip from the top of pole 51 when the user pulls down on upper perimeter 3. A snug fit can be achieved with suitable tolerancing between smooth flexible surfaces on upper end 55 of pole 51 and within hole 65 of head 60. Alternatively, a suitable fit may be achieved if the engagement between upper end 55 and hole 65 is a threaded engagement.

Once the first of suspension arms 20 has been positioned on rim 200, then the remaining arms are positioned in a similar manner. When all suspension arms are snap fitted in their respective positions, the result is as shown in FIG. 1 and a basketball game may proceed.

During the course of play, exuberant players may from time to time try to grab and hold either the net or collar 1 thereby imposing stress on the collar and one or more of the suspension arms 20. To lessen the chances of damage from repeated instances of such use and to lessen the possibility of injury to such players, clip 22 is sufficiently resilient to flex from its normal shape shown in FIGS. 8–11 to the temporarily deformed shape shown in FIG. 12 (viz. in the direction of a3 in FIG. 12). The deformed shape permits suspension arm 20 to be forcibly pulled downwardly from the rim (viz. in the direction of arrow a4 in FIG. 12). Preferably, the required force should be less than the weight of any player who can reach the net. When the force is relieved, clip 22 returns to its normal shape.

Although not depicted in the FIGURES, it will be apparent that positioning device 50 may also be used to disconnect collar 1 from rim 200. More particularly, head 60 may be used to push upwardly on lower perimeter 2 of the collar to force the release of the snap fit of any clip 22 on rim 200. When a clip 22 is released, upper hook 62 may be used to pull the clip outwardly and away from the rim. These steps easily may be repeated for each suspension arm 20. In the case of the last suspension arm, collar 1 and the extension arm may be engaged by head 60 in the manner shown in FIG. 9. Then, the entire apparatus may be lifted upwardly and away from the rim, then lowered to floor level.

Embodiment Shown in FIGS. 15 to 21

The embodiment shown in FIGS. 15 to 21 comprises a collar generally designated 501 and six suspension alms 520 spaced at 60 degree intervals around the circumference of the collar to provide suspension from a basketball rim 200. Each suspension arm includes a hook-shaped upper end 522 and a flange 523 extending downwardly from the upper end to a distal end 524. A hole 526 extends through each flange 523. The apparatus shown also includes a collar positioning device comprising an elongated positioning pole 551 and a positioning head 560.

Figure 15:
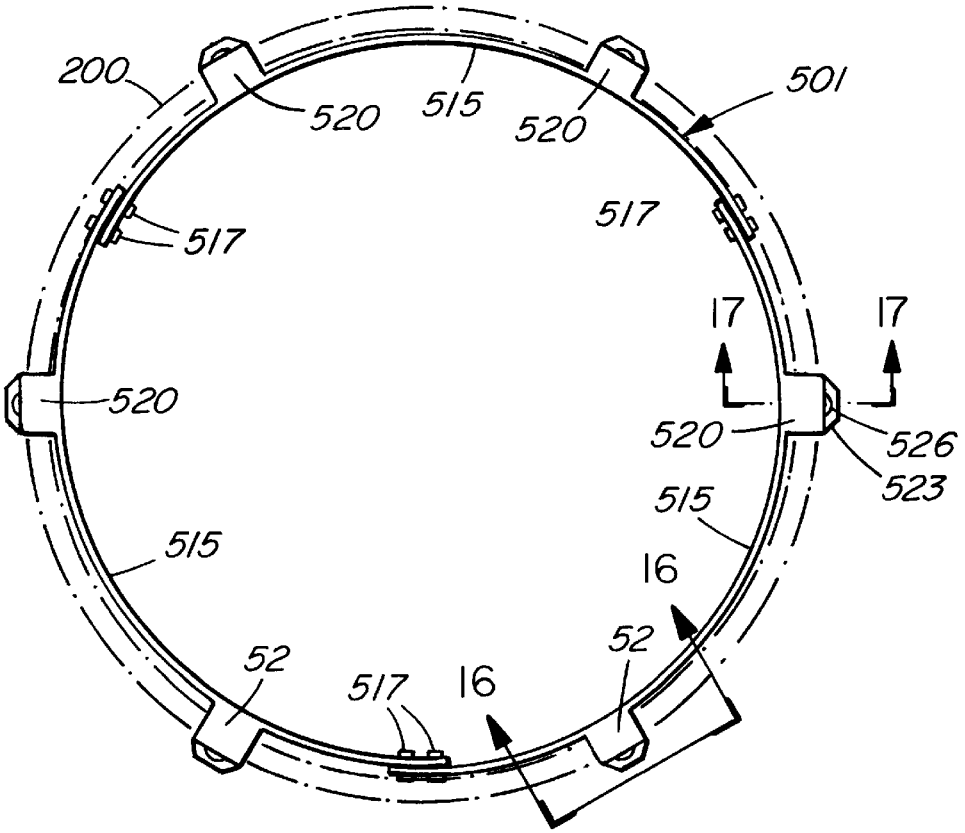
FIG. 15 is a top view of another embodiment of apparatus in accordance with the present invention.

As shown in FIG. 15, collar 501 is made from three identical segments 515 each segment including two of the suspension arms 520. Each segment 515 slightly overlaps the next, the overlapping portions being connected by a pair of bolts 517.

Figure 16:
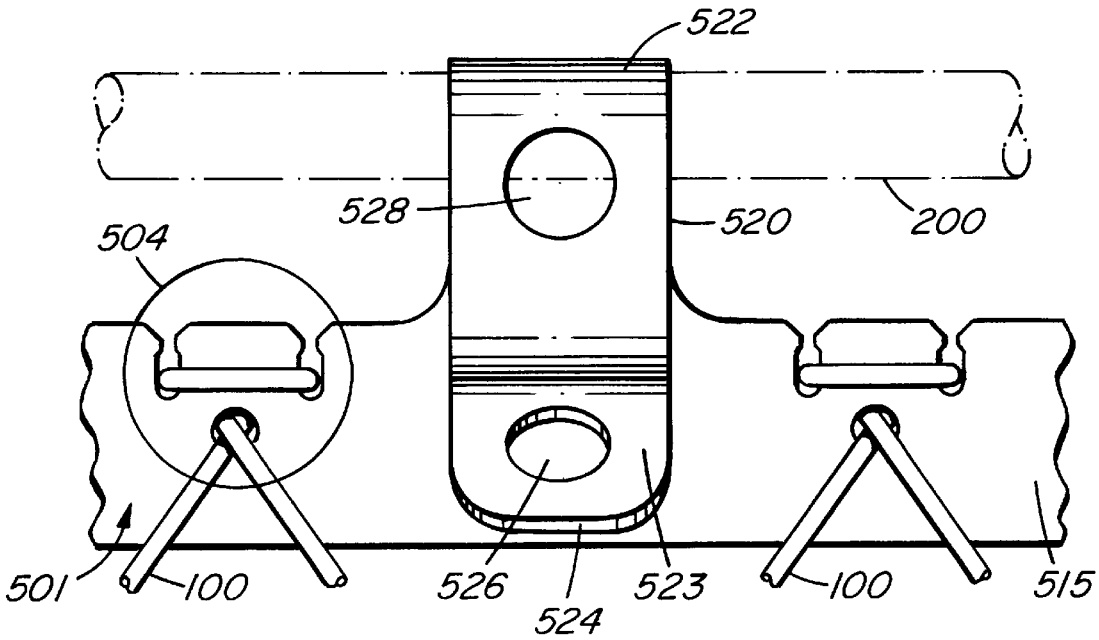
FIG. 16 is an elevation view, partially cut-away, taken from view perspective A—A in FIG. 15, the view highlighting a portion of the collar and one of the suspension arms forming part of the apparatus.

Similar to the case of collar 1, collar 501 is adapted to hold a basketball net 100 by means of twelve hole-and-notch groupings. Such groupings are not illustrated in FIG. 15, but two are shown in FIG. 16, one being contained within the region marked 504. It will be understood that each of the three segments 515 have four hole-and-notched groupings. They are located such that they appear spaced at 30 degree intervals around the circumference of collar 501 when segments 515 are assembled as shown in FIG. 15.

Each segment 515 has a thin sheet construction integrally formed from elastic material having plastic memory. A particular advantage of the segmented structure is that the segments may be readily manufactured by injection molding. To better facilitate injection molding, each suspension arm 520 includes a hole 528 positioned below the top of upper end 522 of the arm and above the top of flange 523 of the arm. Hole 528 also serves to provide some weakening which advantageously allows the arm to deform more easily from its normal shape.

Figure 17:
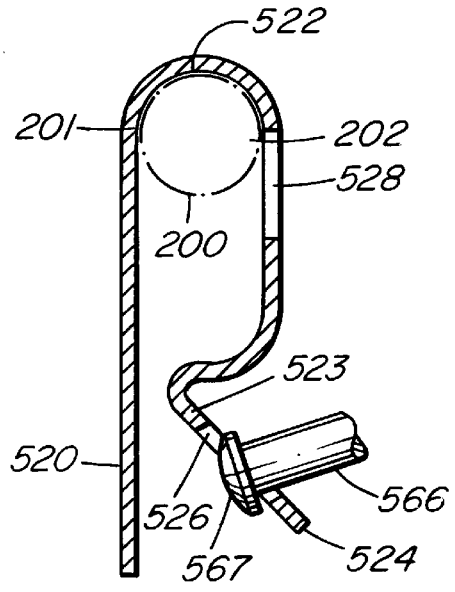
FIG. 17 is a section elevation view of one of the suspension arms forming part of the apparatus in FIG. 15, the view being taken along section line B—B in FIG. 15. As well, FIG. 17 partially depicts the head of a related collar positioning device.

As best seen in FIG. 17, upper end 522 of each suspension arm 520 is sized and positioned to releasably clip on rim 200 outwardly from inner circumference 201 of the rim.

Figure 11:
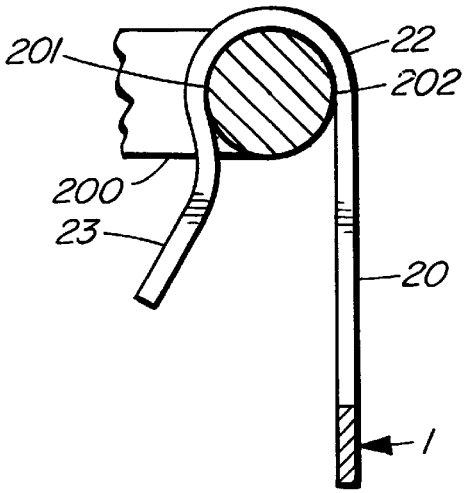
FIG. 11 is a side elevation view illustrating the suspension arm shown in FIG. 10 when clipped on the basketball rim.

This is in contrast to hook-shaped upper ends 22 of suspension arms 20 which, as best seen in FIG. 11, are sized and positioned to clip on rim 200 from outer circumference 202 of the rim. The difference tends to avoid the need for an offset "d" as seen in FIGS. 1 and 2 in those cases where bracing for the rim 200 might otherwise interfere with the positioning of the collar. For this reason, collar 501 does not have an offset "d" as in the case of collar 1.

The action of suspension arms 520 is basically the same as that of suspension arms 20. Upper ends 522 are designed to releasably hook or snap fit on rim 200. Further, they are sufficiently resilient to be forcibly flexed to a deformed shape similar to that indicated in FIG. 12 (but bending back or deforming towards the inside rather than the outside of rim 200), and to return to their normal shape when the deformation force is released. However, it should be noted that the vertical reach of the opening through which rim 200 passes in the case of suspension arm 520 (as best seen in FIG. 17) is more than double that of suspension arm 20. This permits upper ends 522 to snap fit not only on rims like rim 200 but also on double rimmed structures (not shown) where the complete rim may be considered as two rims like rim 200—one secured directly atop the other.

Figure 18:
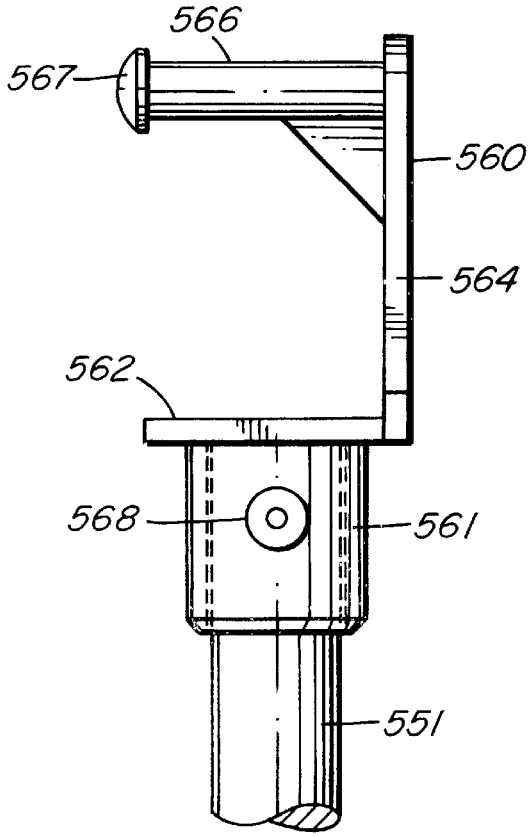
FIG. 18 is an elevation view, partially cut-away, of the collar positioning device partially depicted in FIG. 17.
Figure 19:
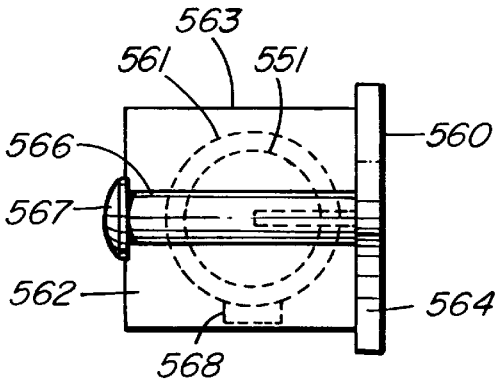
FIG. 19 is a top view of the collar positioning device shown in FIG. 18.
Figure 20:
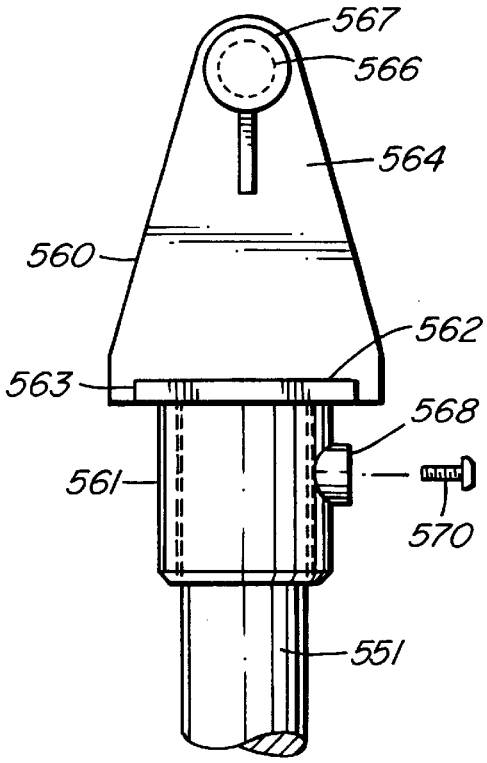
FIG. 20 is a side view, from the left, of the collar positioning device shown in FIG. 18.

As indicated in FIGS. 18 to 20, positioning head 560 is normally mounted atop positioning pole 551 (which may be a telescopable pole as in the case of pole 51). Head 560 includes a base plate 562, a back plate 564 extending upwardly from the base plate, and a pin 566 having a capped ended 567. A cylindrical mounting sleeve 561 extends downwardly from base plate 562. Pin 566 extends horizontally above base plate 562 perpendicularly from back plate 564. A set screw 570 locatable through guide 568 and sleeve 561 is used to releasably secure head 560 in position on pole 551.

Figure 21:
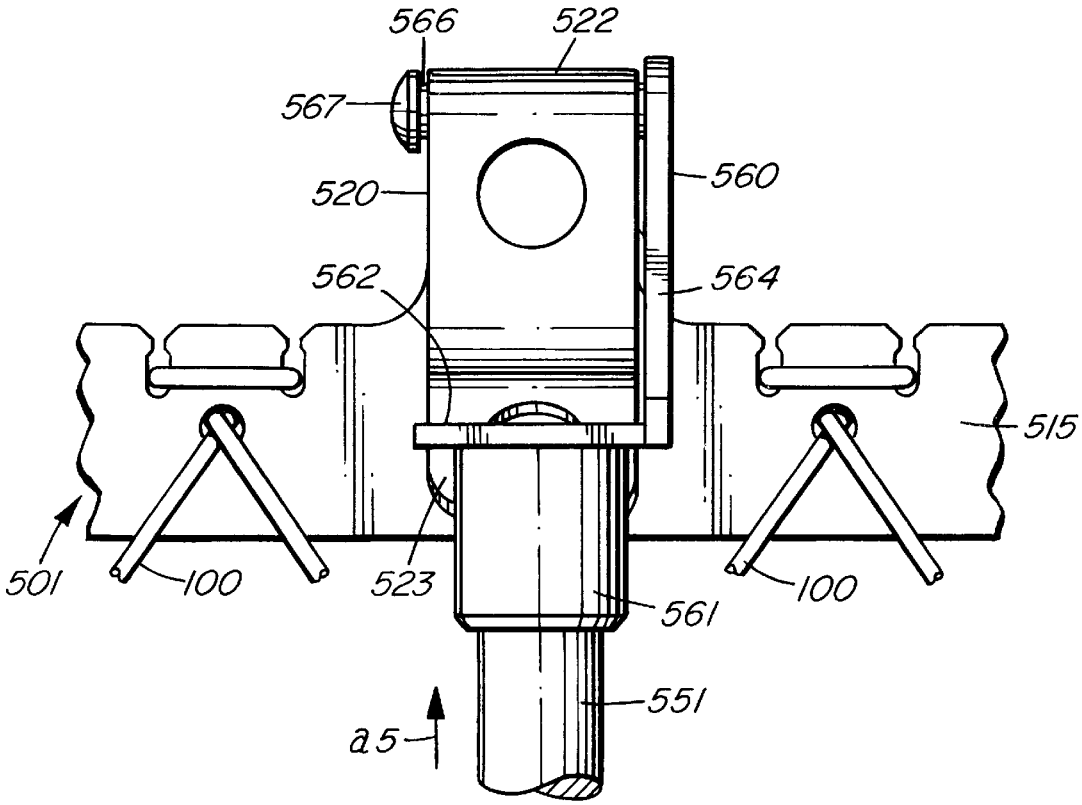
FIG. 21 is an elevation view similar to that shown in FIG. 16, but additionally showing the collar and suspension arm when engaged by the collar positioning device shown in FIGS. 18 to 20.

The use of positioning head 560 will now be described. With reference first to FIG. 21, it can be seen that pin 566 has been inserted beneath upper end 522 of suspension arm 520. Here, pin 566 is in position to provide upward carrying support as collar 501 is lifted in the direction of arrow as. Although not essential, capped end 567 assists to prevent arm 520 from sliding off the pin in the event that the user does not hold pole 551 straight and permits the pole with head 560 to tilt from right to left in FIG. 21. As well, it can be seen in FIG. 21 that flange 523 extends downwardly behind base plate 562. In this position, edge 563 (see FIGS. 19, 20) of base plate 562 provides bracing support against the flange because, when collar 501 is lifted, suspension arm 520 (with collar 501 and net 100) will rotate on pin 566 towards the base plate. The upward lifting support and concurrent bracing support together provide a strong grip which allows a user to easily lift collar 501 towards a basketball rim and to settle suspension arms 520 on the rim in desired positions. When this is done, the final step is to clip the arms with the rim. As indicated in FIG. 17, hole 526 in each flange 523 is designed to facilitate this purpose.

As indicated in FIG. 17, hole 526 in flange 523 of suspension arm 520 is sized for releasable engagement with pin 566. In the position shown, suspension arm 520 is fully clipped on rim 200. It has been drawn to that position by pin 566. However, it will be understood that when suspension arm 520 is initially positioned on rim 200, flange 523 will rest atop the rim. To achieve the fully clipped position, the user has releasably engaged pin 566 with flange 523 through hole 526 and then pulled downwardly on the flange. It should be noted that in the absence of hole 526 the same result might be achieved, albeit with some additional difficulty. More particularly, when flange 523 rests atop rim 200 then suspension arm 520 can be forced to clip on rim by pulling down with pin 566 on the upper perimeter of collar 501 adjacent the arm.

It will be readily apparent that positioning pole 551 with positioning head 560 may also be used to disconnect collar 501 from rim 200. Any suspension arm 520 that remains clipped to rim 200 may be disengaged by pulling flange 523 away from the rim with head 560 and concurrently lifting the arm upwardly away from the rim.

Embodiment Shown in FIGS. 22 to 28

Figure 24:
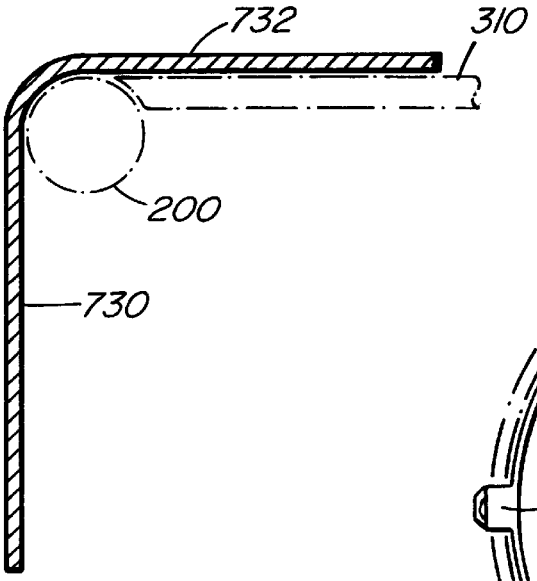
FIG. 24 is a section elevation view taken along section line D—D in FIG. 21.
Figure 22:
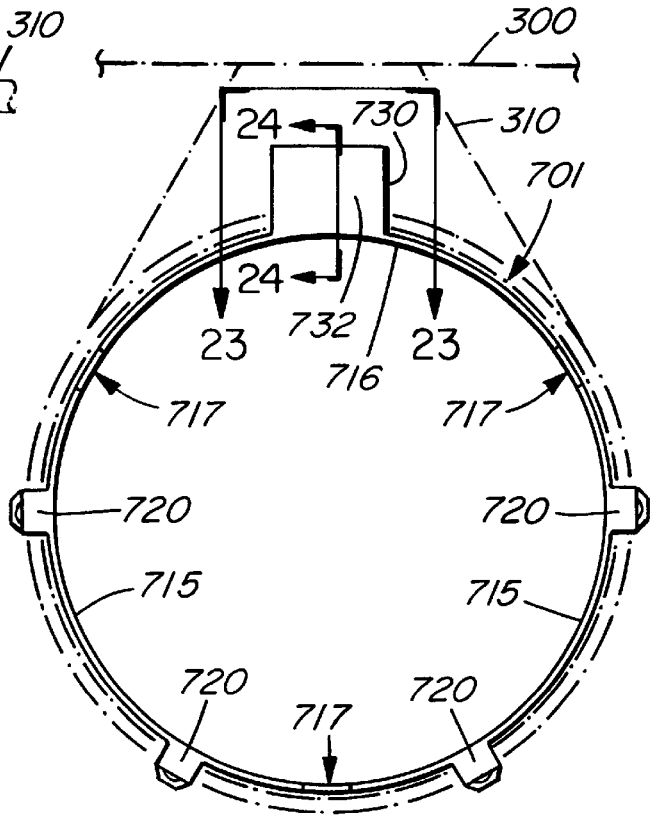
FIG. 22 is a top view of yet another embodiment of apparatus in accordance with the present invention.
Figure 23:
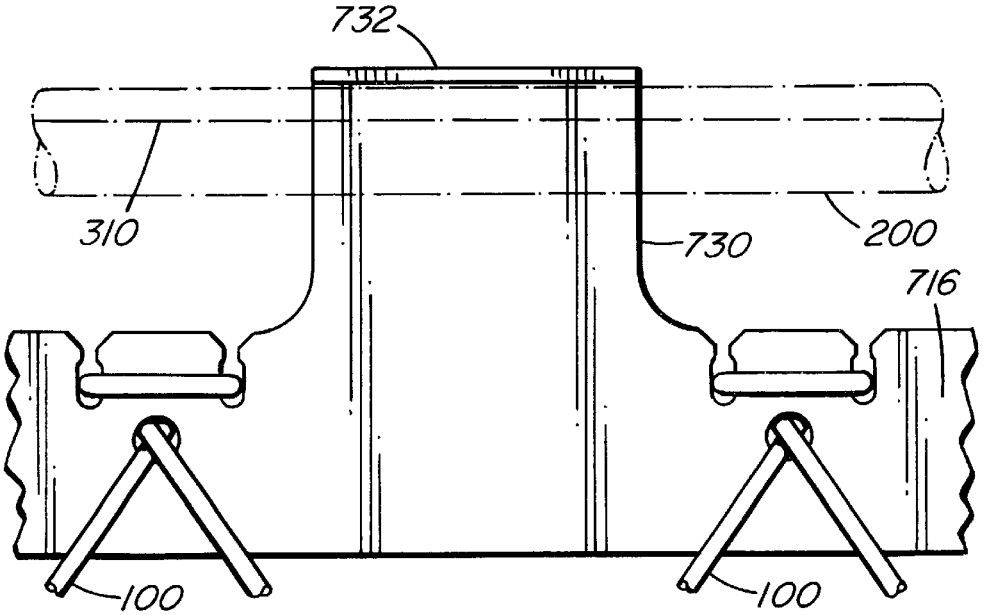
FIG. 23 is an elevation view, partially cut-away, taken from view perspective C—C in FIG. 21.

The embodiment shown in FIGS. 22 to 24 comprises a collar generally designated 701 and five suspension arms to provide suspension from a basketball rim 200. In addition to rim 200, FIGS. 22 to 24 also show in dashed outline a backboard 300 and a horizontally extending reinforcing plate 310 connecting rim 200 to the backboard. Collar 701 and the suspension arms are all formed from elastic material having plastic memory.

Plate 310 can be considered as a variation of plate 306 shown in FIG. 1, and is representative of plates used in some heavily reinforced basketball rim assemblies. It will be noted that plate 310 secures rim 200 along the outer perimeter of rim 200 for an arc distance significantly greater than that of plate 306. The distance is sufficient to impede the use of a collar such as collar 1 in FIG. 1 or collar 501 in FIG. 15. The present embodiment addresses this concern.

Collar 701 is made from two segments 715 and one segment 716, all connected by releasable sleeve and tongue locks generally designated 717. These locks are shown representationally in FIG. 22 and in detail in FIGS. 25 to 28. Each segment 715 or 716, as the case may be, includes an associated sleeve portion 740 at one end of the segment and an associated tongue portion 750 at the opposed end of the segment. The tongue portion 750 of any one segment is snap-fittable with the corresponding sleeve portion 740 of any other segment. Thus the segments as a whole are snap-fittable with each other to form collar 701.

Figure 25:
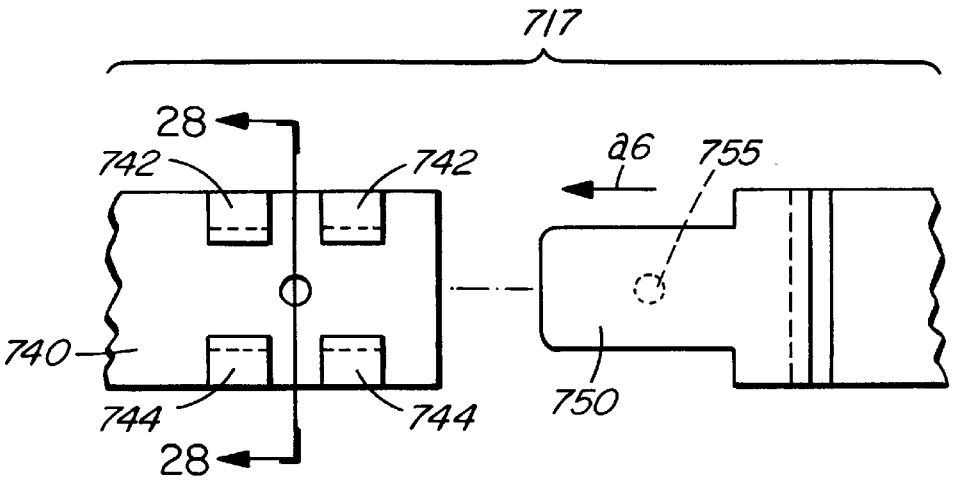
FIG. 25 is an elevation view, partially cut-away, detailing adjacent segments of the collar shown in FIG. 21 as they are being coupled or fitted with each other.
Figure 26:
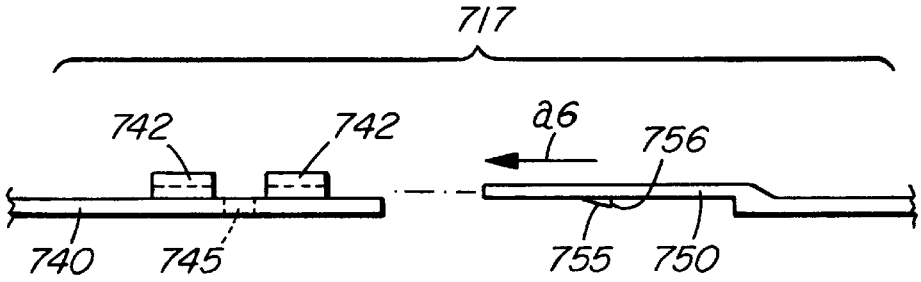
FIG. 26 is a top view, partially cut-away, detailing adjacent segments of the collar shown in FIG. 21 as they are being coupled or fitted with each other.
Figure 27:
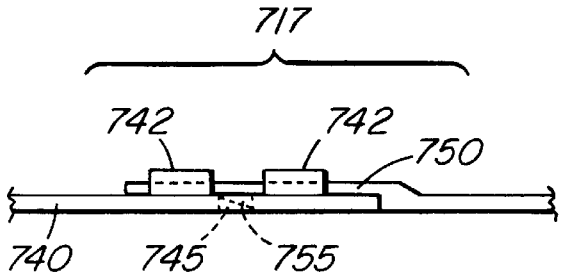
FIG. 27 is a top view, partially cut-away, detailing adjacent segments of the collar shown in FIG. 21 when they are fully coupled or fitted with each other.
Figure 28:
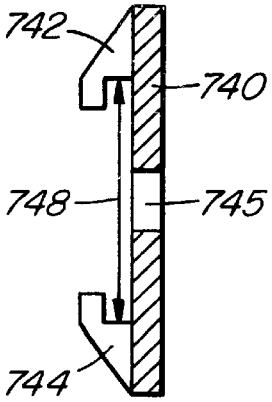
FIG. 28 is a section elevation view taken along section line E—E in FIG. 25.

In more detail, sleeve portion 740 includes integrally molded pairs of upper and lower couplers 742, 744 and a retaining hole 745. Couplers 742, 744 define a rectangular channel 748 (see FIG. 28) that is sized to sliding receive and engage tongue portion 750. Tongue portion 750 includes a ramped retaining boss 755. FIGS. 25 and 26 show tongue portion 750 being moved in the direction of arrow a6 for coupling with sleeve portion 740. FIG. 27 shows tongue portion 750 when fully coupled with sleeve portion 740. In the fully coupled position, retaining boss 755 has snapped into retaining hole 745, and thereby resists decoupling.

As can be seen in FIG. 26, retaining boss 755 protrudes slightly at 756 from the main body of tongue portion 750. Thus, it will be evident to those skilled in the art that the snap-fittable coupling of tongue portion 750 with sleeve portion 740 necessarily is facilitated by the elastic composition of the construction material. However, if desired, the ability to subsequently decouple connected segments may require some experimentation and testing. In this regard, it may be noted that in one prototype using polycarbonate plastic the diameter of retaining hole 745 was about 6 mm. The diameter of retaining boss 755 was toleranced slightly less and had a ramped protrusion of about 1.5 mm. With these dimensions, it was been found not only that tongue portion 750 could be securely coupled with sleeve portion 740 but also that the two portions could be decoupled with a relatively strong pull between the portions.

Segments 715 each include two suspension arms 720 and are basically the same in shape and construction as segments 515 in the embodiment shown in FIGS. 15 to 21. Thus, the portions shown in FIGS. 16 and 17 may be considered representative not only of parts of the embodiment shown in FIGS. 15 to 21, but also of the corresponding parts shown in FIGS. 22 to 24.

Segment 716 differs from segments 715 only in that it includes a unique suspension arm 730 instead of a pair of suspension arms 720. Suspension arm 730 extends upwardly from a lower end integral with segment 716 of collar 701 to a horizontally extending plate-shaped upper end 732 which is sized to extend outward over rim 200 and reinforcing plate 310. As in the case of collar 701 and suspension arms 720, suspension arm 730 is formed from elastic material having plastic memory.

Using a collar positioning device such as that shown in FIGS. 18 to 20, collar 701 may be mounted to basketball rim 200 in substantially the same manner as collar 501. The only added requirement while doing so is to align upper end 732 of suspension arm 730 with plate 310 as shown in FIG. 22. However, the need for this added requirement is mitigated because there are only four suspension arms 720 that need to be clipped to rim 200. As can be seen in FIG. 22, all four such arms clip to the forward half of rim 200 outside the reach of plate 310.

Collar 701 may be disconnected from rim 200 in the same manner that collar 501 may be disconnected from rim 200.

A variety of modifications, changes and variations to the invention are possible within the spirit and scope of the following claims, and will undoubtedly occur to those skilled in the art. The invention should not be considered as restricted to the specific embodiments that have been described and illustrated with reference to the drawings.

We claim:

1. Apparatus for releasably connecting a basketball net to a basketball rim, said apparatus comprising:

(a) a collar adapted to hold said net in an open position permitting passage of said basketball; and, (b) a plurality of suspension arms located at predetermined positions around a circumference of said collar:

(i) each suspension arm extending upwardly from a lower end secured to said collar to a normally hook-shaped upper end;

(ii) each hook-shaped upper end being sized to releasably clip on said rim and, in cooperation with the remaining ones of said hooked-shaped upper ends, to suspend said collar with said net below said rim in a position for basketball play, said collar and said suspension arms having a thin sheet construction formed from elastic material having plastic memory.

2. Apparatus as defined in claim 1, wherein said hook-shaped upper ends are sized and positioned to releasably clip on said rim inwardly from an outer circumference of said rim.

3. Apparatus as defined in claim 1, wherein said hook-shaped upper ends are sized and positioned to releasably clip on said rim outwardly from an inner circumference of said rim.

4. Apparatus as defined in claim 1, wherein said circumference is defined by circumferential segments, including:

(a) a first circumferential segment to which said lower ends of said suspension arms are secured as aforesaid; and, (b) a second circumferential segment connected to and axially offset from said first circumferential segment.

5. Apparatus as defined in claim 1, wherein said suspension arms are integrally formed with said collar.

6. Apparatus as defined in claim 1, further including a collar positioning device comprising:

(a) an elongated positioning pole; and, (b) a positioning head located at an upper end of said pole, said head comprising:

(i) an upwardly opening lower hook for hooking said collar at a selected position from below a lower perimeter of said collar; and, (i) a sideways opening upper hook aligned above and spaced apart from said lower hook for concurrently hooking a selected one of said suspension arms from an upwardly extending side of the selected arm.

7. Apparatus as defined in claim 1, wherein each suspension arm is sufficiently resilient to flex from said normal shape to a deformed shape permitting the suspension arm to be forcibly pulled downwardly from said rim, and to return to said normal shape upon the release of such force.

8. Apparatus as defined in claim 7, wherein said suspension arms are integrally formed with said collar.

9. Apparatus as defined in claim 7, wherein said hook-shaped upper ends are sized and positioned to releasably clip on said rim inwardly from an outer circumference of said rim.

10. Apparatus as defined in claim 7, wherein said hook-shaped upper ends are sized and positioned to releasably clip on said rim outwardly from an inner circumference of said rim.

11. Apparatus as defined in claim 1, wherein each of said suspension arms includes a flange extending downwardly from the associated upper end to a distal end, said apparatus further including a collar positioning device comprising:

(a) an elongated positioning pole; and, (b) a positioning head located at an upper end of said pole, said positioning head including a base plate having an outer edge, a back plate extending upwardly from said base plate, and a pin extending longitudinally above said base plate perpendicularly from said back plate, said pin for providing upward carrying support from beneath the hook-shaped upper end of a selected one of said suspension arms, said edge of said base plate for concurrently providing bracing support against said flange of the selected suspension arm.

12. Apparatus as defined in claim 11, wherein each of said flanges includes a hole extending through the flange, said hole being sized for releasable engagement by said pin.

13. Apparatus as defined in claim 12, wherein each of said suspension arms includes a second hole positioned below the top of said hook-shaped upper end of the suspension arm and above the top of said flange of the suspension arm.

14. Apparatus as defined in claim 13, wherein each suspension arm is sufficiently resilient to flex from said normal shape to a deformed shape permitting the suspension arm to be forcibly pulled downwardly from said rim, and to return to said normal shape upon the release of such force.

15. Apparatus as defined in claim 14, wherein said collar comprises a plurality of identically formed circumferential segments connected to form said collar.

16. Apparatus as defined in claim 15, wherein equal numbers of said suspension arms integrally merge with and extend upwardly from associated ones of said segments.

17. Apparatus as defined in claim 16, wherein said segments are snapfittable with each other to form said collar.

18. Apparatus as defined in claim 17, wherein the number of said segments is three.

19. Apparatus for releasably connecting a basketball net to a basketball rim, said rim being reinforced by a horizontally extending reinforcing plate extending rearwardly from said rim, said apparatus comprising:

(a) a collar adapted to hold said net in an open position permitting passage of said basketball;

(b) a plurality of suspension arms located at predetermined positions around the circumference of said collar.

(i) a first one of said suspension arms extending upwardly from a lower end secured to said collar to a horizontally extending plate-shaped upper end, said plate-shaped upper end being sized to extend outward over said rim and over said reinforcing plate;

(ii) additional ones of said suspension arms, each extending upwardly from a lower end secured to said collar to a normally hook-shaped upper end;

(iii) each hook-shaped upper end being sized to releasably clip on said rim from said inner circumference of said rim and, in cooperation with the remaining ones of said hooked-shaped upper ends and said plate-shaped upper end, to suspend said collar with said net below said rim in a position for basketball play, said collar and said suspension arms having a thin sheet construction formed from elastic material having plastic memory.

20. Apparatus as defined in claim 19, wherein said collar comprises three circumferential segments connected to form said collar, and wherein:

(a) said first one of said suspension arms extends upwardly from an associated first one of said circumferential segments; and, (b) equal numbers of said additional ones of said suspension arms extend upwardly from associated ones of the remaining two of said circumferential segments.

21. Apparatus as defined in claim 20, wherein each suspension arm integrally merges with its associated circumferential segment.

22. Apparatus as defined in claim 21, wherein each suspension arm is sufficiently resilient to flex from said normal shape to a deformed shape permitting the suspension arm to be forcibly pulled downwardly from said rim, and to return to said normal shape upon the release of such force.

23. Apparatus as defined in claim 21, wherein said segments are snapfittable with each other to form said collar.

* * * * *